United States Patent [19]

Hahn

[11] Patent Number: 4,693,439

[45] Date of Patent: Sep. 15, 1987

[54] CAP CARD

[75] Inventor: Jerome S. Hahn, Boca Raton, Fla.

[73] Assignee: Concept Engineering and Design Corporation, Tallahassee, Fla.

[21] Appl. No.: 836,972

[22] Filed: Mar. 6, 1986

[51] Int. Cl.[4] ..... A47G 21/14

[52] U.S. Cl. ..... 248/37.6; 248/300

[58] Field of Search ..... 248/37.3, 37.6, 300; 206/553, 44.11; 211/70.6; 30/1; D7/74

[56] References Cited

U.S. PATENT DOCUMENTS

| | | | |
|---|---|---|---|
| D. 141,898 | 7/1945 | Glukes | D7/74 |
| D. 247,735 | 4/1978 | Gangelhoff | D7/74 |
| 1,665,620 | 4/1928 | Amatel | 206/44.11 |
| 1,894,974 | 1/1933 | Bleckley | 248/37.6 UX |
| 1,901,583 | 3/1933 | Conway | 211/70.6 X |
| 2,126,461 | 8/1938 | Graham | 206/44.11 |

*Primary Examiner*—J. Franklin Foss

*Attorney, Agent, or Firm*—Amster, Rothstein and Ebenstein

[57] ABSTRACT

A cap card for a knife holder having, generally, a planar construction with at least one slot in approximate registration with a corresponding slot existing in a knife holder. The cap card may be made of a number of materials, such as, but not limited to, plastic, wood or, preferably, cardboard. Generally, the knife holder will have a plurality of slots of various sizes to hold knives of different sizes. To accommodate the knife holder, the cap card would preferably have an equal plurality of corresponding slots. The slots of the cap card are to be of a slightly narrower than the width of the blade of the knife to be held. This feature is designed to create an interference or friction fit between the slots of the cap card and the knife inserted therethrough so that the knives may be securely held to prevent their movement during transport which would otherwise tend to cause damage to the area of the slots around the knife holder.

15 Claims, 5 Drawing Figures

CAP CARD

This invention relates generally to a cap card. More particularly, this invention relates to a cap card for use as a means for securely packing knives in a conventional knife holder, such as a wooden block, during transport, for example, from a place of manufacture to the location of an intended sale. In a preferred embodiment of the invention, a point-of-sale display is an integral part of the novel cap card.

Heretofore, in order to properly transport knives together with knife holders, it was necessary to pack the knives separately from the knife holder rather than shipping the knives in the holder itself. This mode of shipping was required in order to prevent the knives from damaging the knife holder in the area around the apertures of the holder as a result of the knives moving relative to and abraiding the holder. Moreover, in order to provide a point-of-sale display, it was necessary to either fasten a label to the knife holder with an adhesive, which tended to mar the finish of the holder, or to attach a string tag to the holder which had a tendency of bcoming detached during shipment. Thus, prior to the present invention, there had been no satisfactory means of presenting consumer point-of-sale information for such products.

Accordingly, the present invention overcomes many of the disadvantages of the prior art by providing a cap card for a knife holder having a generally planar construction with at least one slot in approximate registration with a corresponding slot existing in the knife holder. The cap card may be made of various materials, such as, but not limited to, plastic, wood or, preferably, cardboard. Generally, the knife holder will have a plurality of slots of various sizes to hold knives of correspondingly different sizes. To accommodate such a knife holder, the inventive cap card would, preferably, have an equal plurality of corresponding slots. The slots of the novel cap card are to be of a slightly smaller dimension than the corresponding slots of the knife holder. This construction feature is designed to create an interference or friction fit between the slots of the cap card and the knife inserted therethrough. This interference fit creates the dual benefits of permitting the cap card to securely retain the knives in place during transit while the knives cause the cap card to remain in place during display. Preferably, the registration between the slots of the cap card and the corresponding slots of the knife holder is such that the blades of the knife to be held by the holder are pressed against or frictionally engage the inner surfaces of the slots of the knife holder. Particularly when a plurality of knives are shipped in the knife holder incorporating a cap card of the present invention, the engagement of the plurality of blades with the inner surfaces of the slots of the knife holder secure the knives within the knife holder during transport. Once the plurality of knives are secured in such manner, the cap card prevents the knife blades from damaging the area around slots in the knife holder near its top surface.

In a preferred embodiment of the invention, a display panel is provided, integral with the novel cap card. The display panel is preferably utilized as a convenient point-of-sale display which avoids the numerous disadvantages inherent of such displays as discussed above.

Accordingly, it is an object of the present invention to provide a cap card for use as a means for securely packing knives in a knife holder such as a wooden block, for transport, for example, from a place of manufacture to the location of an intended sale which prevents the knives from damaging the knife holder during transit and eliminates the need to package the knives separate from the knife holder.

It is also an object of the present invention to provide means for a convenient point-of-sale display for a set of knives within a knife holder that will not mar the finish of the holder and which will not become detached therefrom during shipment.

It is a further object of the invention to provide a cap card that is economical to construct.

Other objects and features of the present invention will become apparent from the following detailed description when taken in conjunction with the accompanying drawings, which disclose several embodiments of the invention. It is to be understood that the drawings are designed for the purpose of illustration only and are not intended as a definition of the limits of the invention.

In the drawings, wherein similar reference numerals denote similar elements throughout the several views.

Figure 1:
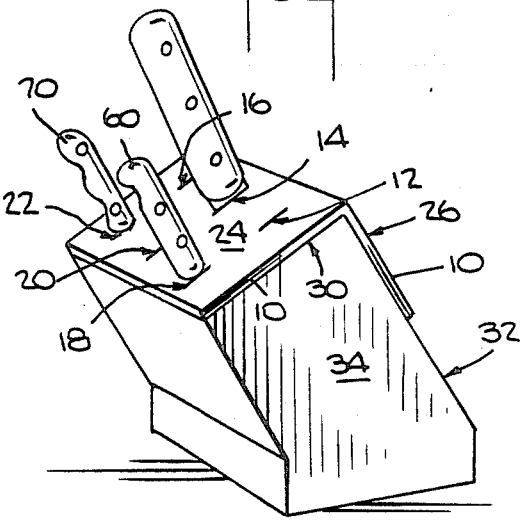
FIG. 1 is a perspective view of a set of knives engaging a knife holder and being secured in place by a cap card in accordance with the invention.

Turning now to a detailed description of the preferred embodiments, FIG. 1 shows an embodiment of the inventive cap card 10 with top segment 24 overlaying a top face 30 and side segment 26 overlaying a backside 32 of a knife holder 34. Cap card 10 contains numerous slots through top segment 24, herein designated by reference numerals 12, 14, 16, 18, 20, 22, through which the blades of the knives pass when inserted within the slots in knife holder 34. This figure shows knives 50, 60, 70 engaging knife holder 34 by being passed through slot 14, 18, 22 of cap card 10. Cap card 10, of course, may have either a lesser number or a greater number of slots. Generally, the number of slots provided through cap card 10 are equal to the number of slots provided in the knife holder.

Figure 2:
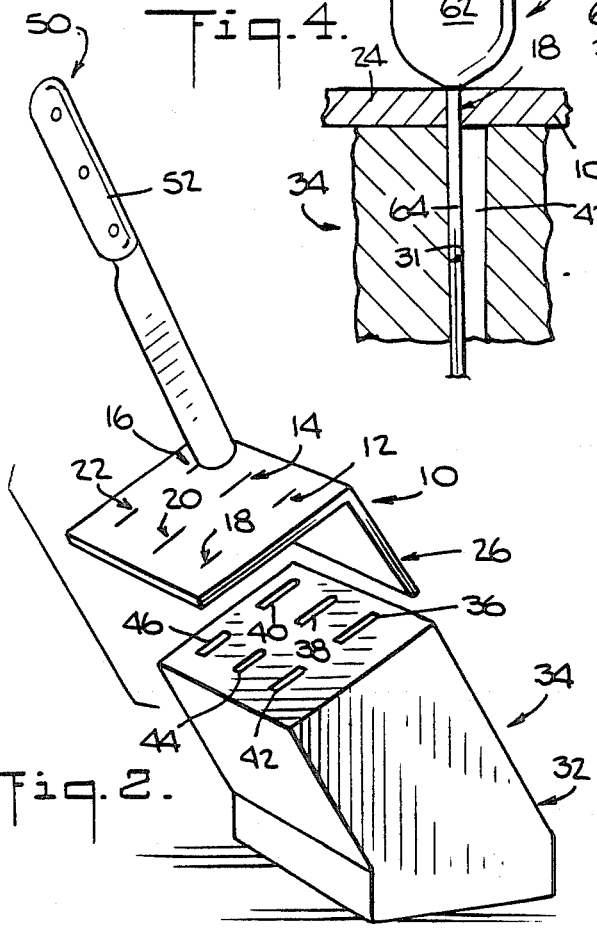
FIG. 2 is an exploded perspective view of a knife, the inventive cap card and a knife holder prior to the engagement of these items as illustrated in FIG. 1.

Referring now to FIG. 2, presented is an exploded perspective view of knife 50, having handle 52 and blade 54. Also shown in cap card 10 with top segment 24, having slots 12, 14, 16, 18, 20, 22 and being connected to said segment 26. Knife holder 34 is illustrated with top face 30 and backside 32. Top face 30 of the knife holder is provided with slots 36, 38, 40, 42, 44, 46 each of which essentially has two inner walls extending into knife holder 34 by a distance that is greater than the length of the blade of the knife to be engaged by cap card 10 and inserted into knife holder 34. As presented, slots 12, 14, 16, 18, 20, 22 of cap card 10 are narrower than slots 36, 38, 40, 42, 44, 46 of knife holder 34. The slots of cap card 10 and the slots of knife holder 34 are aligned with one another in approximate registry so that knife 50 may pass through a slot in cap card 10 and into a slot in knife holder 34. Because the slots in top segment 24 of cap card 10 are very narrow, an interference fit between blade 54 of knife 50 and cap card 10 is created. This interference fit creates the dual benefits of permitting cap card 10 to securely retain the knives in place during transit while also allowing the knives placed through cap card 10 to hold the cap card in place. As a result, movement between the knives and the knife holder 34, particularly in the area of the top face 30 of knife head 34 is effectively eliminated thereby tending to reduce damage to the area around slots 36, 38, 40, 42, 44, 46 near top face 30 of knife holder 34. Slots 12, 14, 16, 18, 20, 22 of cap card 10 are, generally, considerably narrower than slots 36, 38, 40, 42, 44, 46 of knife holder 34. Since the slots of knife holder 34 are relatively wide in comparison to each blade 54 that a knife 50 is not securely held by knife holder 34 during transit and, therefore, requires the use of cap card 10. Slots 12, 14, 16, 18, 20, 22 being narrow, create an interference fit with blade 54 to hold knife 50 within the cap card 10 to prevent the movement of the knife during transport thereby preventing the damage described above.

Figure 3:
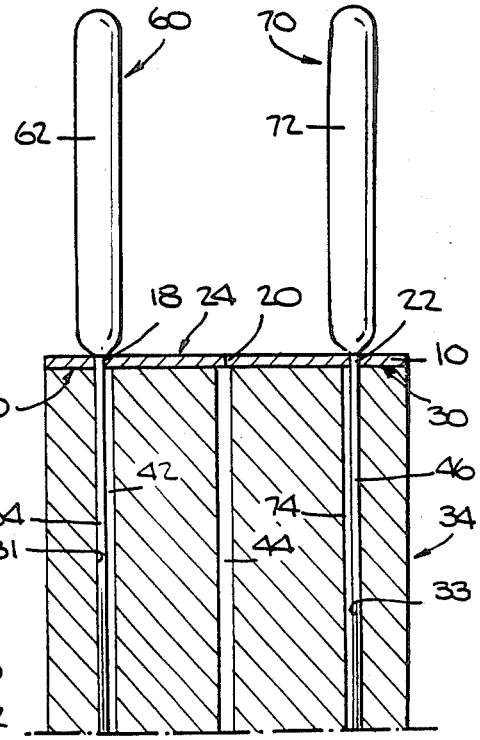
FIG. 3 is a side view in cross-section of a set of knives engaging a knife holder and being secured in place by the cap card.

FIG. 3 shows knives 60, 70 engaging knife holder 34 and secured by cap card 10. Knives 60 and 70 are each shown passing through slots 18 and 22, respectively, of cap card 10 and into slots 42 and 46 of knife holder 34. In this particular embodiment, slots 18, 20, 22 of cap card 10 are not in a precise registration with slots 42, 44, 46 of knife holder 34. This construction causes blades 64 of knife 60 to frictionally engage a first inner surface 31 of slot 42. Similarly, blade 74 frictionally engages a second inner surface 33 of slot 46 of knife holder 34. Consequently, this preferred embodiment results in an even more secure hold of the knives and cap card during transit.

Figure 4:
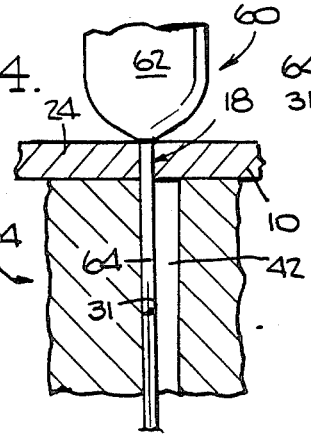
FIG. 4 is a fragmentary view in enlarged scale of the view presented in FIG. 3 showing the engagement of a single knife with a knife holder and the cap card.

FIG. 4 shows a fragmentary view, in enlarged scale, of the engagement of knife 60 with cap card 10 and knife holder 34. The lack of a precise registration between slot 18 of cap card 10 and slot 42 in knife holder 34 causes blade 64 of knife 60 to frictionally engage inner surface 31 of slot 42 of knife holder 34. As mentioned above, this construction feature provides an even more secure hold of the knife by cap card 10 and knife holder 34.

Figure 5:
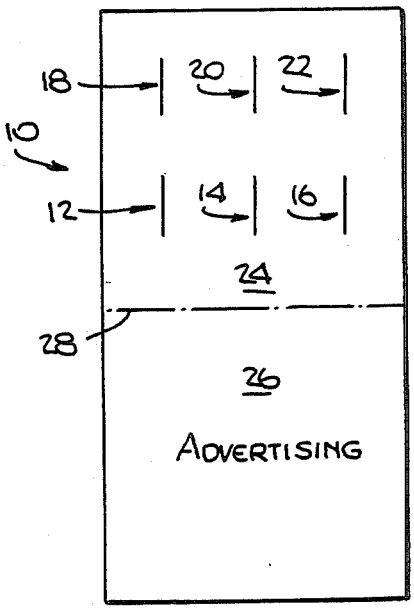
FIG. 5 is a plan view of the cap card according to the invention prior to engagement with a set of knives and a knife holder.

Finally, FIG. 5 shows cap card 10 having six slots 12, 14, 16, 18, 20, 22 through top segment 24. However, there may be a different number of slots with the actual number and positioning of such slots generally depending upon the corresponding number and position of slots in the top face of the knife holder to be used. Top segment 24 and side segment 26 interface along line 28. Side segment 26, which may have numerous possible shapes, e.g., rectangular, is not essential for a proper operation of cap card 10 and may be omitted. The function of side segment 26 is to provide a means for a point-of-sale display by permitting the display of information thereon. Side segment 26, unlike displays heretofore known, which are typically attached directly to the knife holder by an adhesive, is not fastened to the knife holder and, thus, would not mar the finish of the holder upon removal of the point-of-sale display.

In a preferred embodiment of cap card 10, the cap card of the present invention is constructed of a flexible material, for example, cardboard. When a side segment is used, the interface along line 28 is preferably, a hingeable connection constructed by folding cap card 10 to create such a hinge.

It should be apparent to one skilled in the art that, as earlier discussed, cap card 10 need not be made of a flexible material, but, instead, could be constructed of such materials as, for example, rigid plastic or wood. If a side segment 26 is employed, the construction of cap card 10 should compliment the shape of the knife holder utilized so that it may properly rest on the holder.

It should be apparent that other variations may be made as will be apparent to those skilled in the art. For example, the cap card of the present invention may be provided with numerous shapes other than those disclosed herein as well as being provided with a varying number of slots.

Thus, while only several embodiments of the present invention have been shown and described, it will be obvious that many changes and modifications may be made thereunto without departing from the spirit and scope of the invention.

What is claimed is:

1. A cap card for a holder for at least one knife with a conventional blade, comprising:

a substantially planar material having at least one slot in approximate registry with a corresponding slot in said holder, said slot in said substantially planar material being slightly narrower than the width of said blade of said knife to be held by said slot in said holder and narrower than the width of said slot of said holder so that when said knife engages said holder, an inteference fit is created between said substantially planar material and said knife thereby securing said knife in said holder.

2. The cap card according to claim 1, wherein said substantially planar material is cardboard.

3. The cap card according to claim 1, wherein said substantially planar material is plastic.

4. The cap card according to claim 1, wherein said substantially planar material is wood.

5. The cap card according to claim 1, further comprising a panel hingeably connected to said substantially planar material said panel being constructed and arrange to display information thereon.

6. The cap card according to claim 5, wherein said panel is made of the same material as said substantially planar material with said hingeable connection being created by folding a portion of said substantially planar material.

7. A cap card for a holder for at least two knives each having a conventional blade, comprising:

a substantially planar material having at least two slots in approximate registry with at least two corresponding slots in said holder, said slots in said holder each having a first inner surface and a second inner surface and said slots of said substantially planar material being narrower than said slots in said holder and slightly narrower than the width of said blades of said knives to create an interference fit when said knives engage said substantially planar material, so that when, as a result of said approximate registry, said knives engage said slots of said holder, said first knife frictionally engages the first inner surface of one of said slots of said holder and said second knife frictionally engages said second inner surface of the other slot of said holder thereby creating a secure hold of said knife in said holder.

8. The cap card according to claim 7, wherein said substantially planar material is cardboard.

9. The cap card according to claim 7, wherein said substantially planar material is plastic.

10. The cap card according to claim 7, wherein said substantially planar material is wood.

11. The cap card according to claim 7, further comprising a panel hingeably connected to said substantially planar material said panel being capable of displaying information thereon.

12. The cap card according to claim 11, wherein said panel is made of the same material as said substantially planar material with said hingeable connection being created by folding a portion of said substantially planar material.

13. A cap card for a holder for at least one knife with a conventional blade, comprising:

a substantially planar material having at least one slot in approximate registry with a corresponding slot in said holder, said slot in said substantially planar material being narrower than said slot in said holder and slightly narrower than the width of said blade of said knife to be held by said slot in said holder so that when said knife engages said holder an interference fit is created between said substantially planar material and said knife thereby securing said knife in said holder; and a panel hingeably connected to said substantially planar material, said panel being constructed and arranged to display information thereon.

14. The cap card according to claim 13, wherein said panel is made of the same material as said substantially planar material with said hingeable connection being created by folding a portion of said substantially planar material.

15. The cap card according to claim 13, wherein said substantially planar material and said panel are made of cardboard.

* * * * *